United States Patent [19]

Kharitonov et al.

[11] Patent Number: 4,993,098

[45] Date of Patent: Feb. 19, 1991

[54] APPARATUS FOR VIBRATORY CLEANING THE SURFACE OF AN ARTICLE FROM FOREIGN MATTER

[76] Inventors: Vladimir D. Kharitonov, ulitsa Krupskoi, 8, korpus I, kv. 21; Vadim Y. Granovsky, Volgogradsky prospekt, 157, korpus 2, kv. 14; Pavel V. Kuznetsov, ulitsa Rustaveli, 19, kv. 51, all of Moscow; Alexandr P. Odnoral, ulitsa Krasny Oktyabr, 3, kv. 34, Moskovskaya oblast, Dedovsk; Anatoly V. Voronov, ulitsa Lenina, 13, kv. 4, Moskovskaya oblast, Istra, all of U.S.S.R.

[21] Appl. No.: 427,112

[22] PCT Filed: Feb. 19, 1988

[86] PCT No.: PCT/SU88/00041

§ 371 Date: Oct. 18, 1989

§ 102(e) Date: Oct. 18, 1989

[87] PCT Pub. No.: WO89/07492

PCT Pub. Date: Aug. 24, 1989

[51] Int. Cl.[5] ..... B08B 9/02; F28G 7/00

[52] U.S. Cl. ..... 15/91; 15/3; 15/104.04; 29/DIG. 46

[58] Field of Search ..... 15/1, 3, 89, 91, 92, 15/104.04; 29/DIG. 46, 81 R; 222/196, 198; 366/108, 114, 116, 127; 165/84, 95

[56] References Cited

FOREIGN PATENT DOCUMENTS

| | | |
|---|---|---|
| 213589 | 3/1972 | U.S.S.R. . |
| 528962 | 11/1979 | U.S.S.R. . |
| 804010 | 2/1981 | U.S.S.R. . |
| 1379894 | 9/1988 | U.S.S.R. . |

*Primary Examiner*—Edward L. Roberts
*Attorney, Agent, or Firm*—Ladas & Parry

[57] ABSTRACT

The apparatus for vibratory cleaning the surface of an article from foreign matter, comprising at least one exciter (1) of mechanical pulses, including an electromagnetic inductor (2) with a plate (3), a frame (7) and at least one striking surface to be cleaned in an area or areas of the most probable location of the foreign matter, fixedly mounted on the frame (7). Each electromagnetic inductor (2) with the plate (3) closely adjoining this inductor (2) is fixedly mounted on the frame (7).

3 Claims, 3 Drawing Sheets

APPARATUS FOR VIBRATORY CLEANING THE SURFACE OF AN ARTICLE FROM FOREIGN MATTER

TECHNICAL FIELD

The invention relates to apparatus intended for cleaning and prevention of soiling, by employing vibration of the surfaces to be cleaned, and more particularly it relates to an apparatus for vibratory cleaning the surface of an article from foreign matter.

PRIOR ART

There is known an apparatus (SU, A, 213589) for removing ice from a casing or skin (of a vessel, aircraft, etc.), comprising an exciter of mechanical pulses which, for the purpose of directly exciting strain in the skin to be cleaned while minimizing the hazard of its being damaged, comprises a chamber filled with a non-conducting (dielectric) fluid, having electrodes mounted therein, connected to an electric discharge current source, the walls of this chamber or at least a part of these walls being the very skin to be cleaned. However, this apparatus cannot be used for cleaning surfaces made of materials with low electric conductivity, such as surfaces made of stainless steel, e.g. bins, hoppers, cyclenes, drying chambers, pneumatic transport lines, air ducts, etc., on account of the pulsed magnetic field penetrating the surface being cleaned. Moreover, the described apparatus has been found to provide inadequate efficiency of the cleaning of a surface.

There is further known an apparatus for vibratory cleaning the surface of an article from foreign matter (SU, A, 528962), comprising at least one exciter of mechanical pulses, including an electromagnetic inductor and a plate made of an electrically conductive material, arranged between the electromagnetic indicator and the surface to be cleaned. The electromagnetic inductor is connected to a source of pulsed electric current. This known apparatus for vibratory cleaning the surface of an article from foreign matter further comprises a vibration-transmitting member. This apparatus offers a relatively low efficiency factor, on account of the existence of a gap between the plate and the electromagnetic inductor, as this gap hinders the interaction of the electromagnetic field of the electromagnetic inductor with the eddy currents induced in the plate. Moreover, this apparatus of the prior art is capable of cleaning only that portion of the surface of an article which adjoins the electromagnetic inductor, and this results in the insufficient degree of the cleaning of the surface of the article. Thus, the apparatus of the prior art does not provide the necessary efficiency of the cleaning of the article surface.

DISCLOSURE OF THE INVENTION

It is an object of the present invention to create a device for vibratory cleaning of the surface of an article from foreign matter, which should provide for stepping up the efficiency of the operation of cleaning the surface of the article.

SOLUTION TO THE TECHNICAL PROBLEM

This invention is to provide an apparatus for vibratory cleaning the surface of an article from foreign matter, comprising at least one exciter of mechanical pulses, including an electromagnetic inductor connected to a source of pulsed electric current, and a plate made of an electrically conductive material, arranged between the electromagnetic inductor and the surface of the article to be cleaned, which apparatus, in accordance with the present invention, further comprises a frame having fixedly mounted thereon the electromagnetic inductor and the plate closely adjoining this electromagnetic inductor, and at least one striking member arranged between the frame and the surface of the article to be cleaned in the area or areas of the most probable location of the foreign matter, the striking member being fixedly mounted on the frame.

It is expedient that the striking member in the apparatus for vibratory cleaning the surface of an article from foreign matter should be in the form of a rigid element.

It is further expedient that the apparatus for vibratory cleaning the surface of an article from foreign matter should have at least one striking member in the form of an electromagnetic inductor connected to an auxiliary source of pulsed electric current, with a plate closely adjoining the electromagnetic inductor and arranged between the electromagnetic inductor and the surface of the article to be cleaned.

The disclosed apparatus for vibratory cleaning the surface of an article from foreign matter provides for eliminating manual labour and introducing automation into the process of cleaning all kinds of equipment. into the process of cleaning all kinds of equipment. Furthermore, the disclosed apparatus provides for avoiding the eventuality of damaging the surface of the equipment, thus prolonging the service life of this equipment. The disclosed apparatus for vibratory cleaning the surface of an article from foreign matter also provides for enhancing the efficiency of the operation of cleaning the article surface.

BRIEF DESCRIPTION OF DRAWINGS

The invention will be further described in connection with its embodiments, with reference being made to the accompanying drawings, wherein.

BEST MODE FOR CARRYING OUT THE INVENTION

Figure 1:
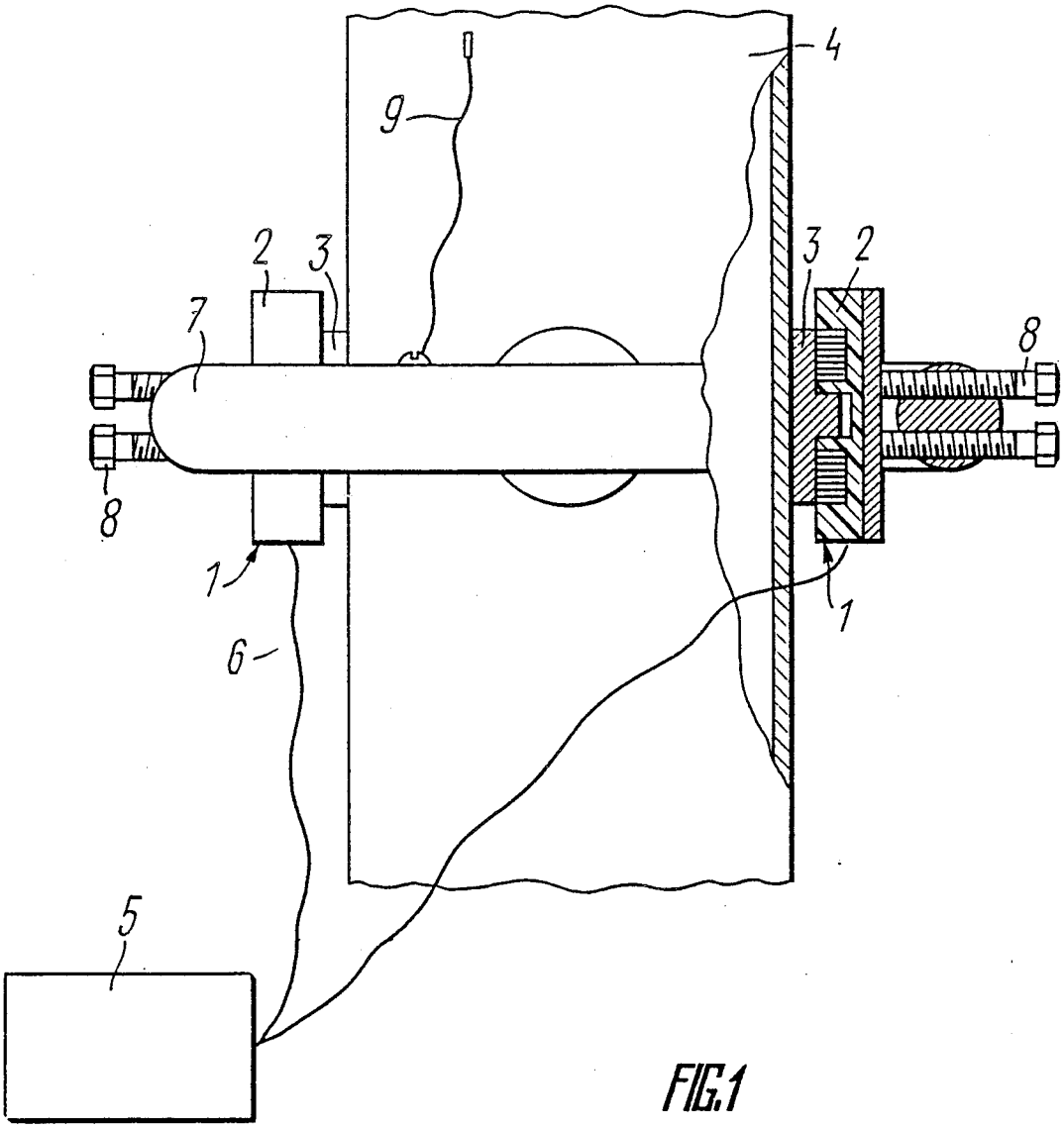
FIG. 1 illustrates schematically a partly sectional general view of an apparatus for vibratory cleaning the surface of an article from foreign matter, mounted on the surface of the article to be cleaned, in accordance with the invention.
Figure 2:
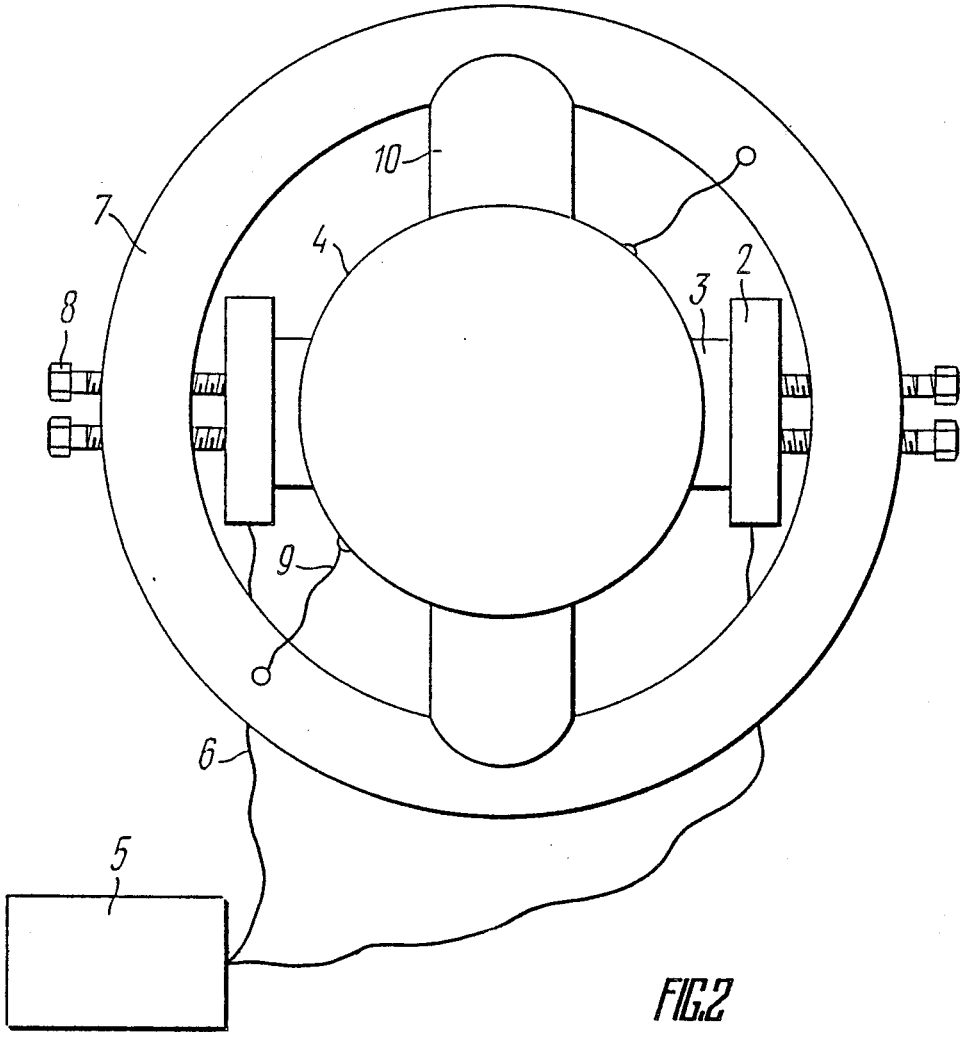
FIG. 2 illustrates the apparatus for vibratory cleaning the surface of an article from foreign matter, embodying the invention, in a plan view.

In the drawings, the apparatus for vibratory cleaning the surface of an article from foreign matter comprises at least one exciter 1 (FIG. 1) of mechanical pulses (there being two exciters 1 in the embodiment being described, illustrated in FIG. 1). Each exciter 1 of mechanical pulses comprises an electromagnetic inductor 2 and a plate 3 of an electrically conductive material, interposed between the electromagnetic inductor 2 and the surface of an article 4 to be cleaned. The apparatus for vibratory cleaning the surface of an article from foreign matter further comprises a source 5 of pulsed electric current, connected via a power cable 6 to the exciter 1 of mechanical pulses, and a frame 7. The frame 7 has the electromagnetic inductors 2 with their respective plates 3 closely adjoining them fastened to it by bolts 8. The frame 7 is supported at the surface of the article 4 to be cleaned by flexible ties 9. The apparatus being described also comprises two striking members 10 (FIG. 2) accommodated between the frame 7 and the surface of the article 4 to be cleaned at the areas of the most probable location of foreign matter, the striking members 10 made fast with the frame 7, e.g. by welding. Each striking member 10 is in the form of a rigid element, which in the presently described embodiment is in the form of a portion of a metal bar.

Figure 3:
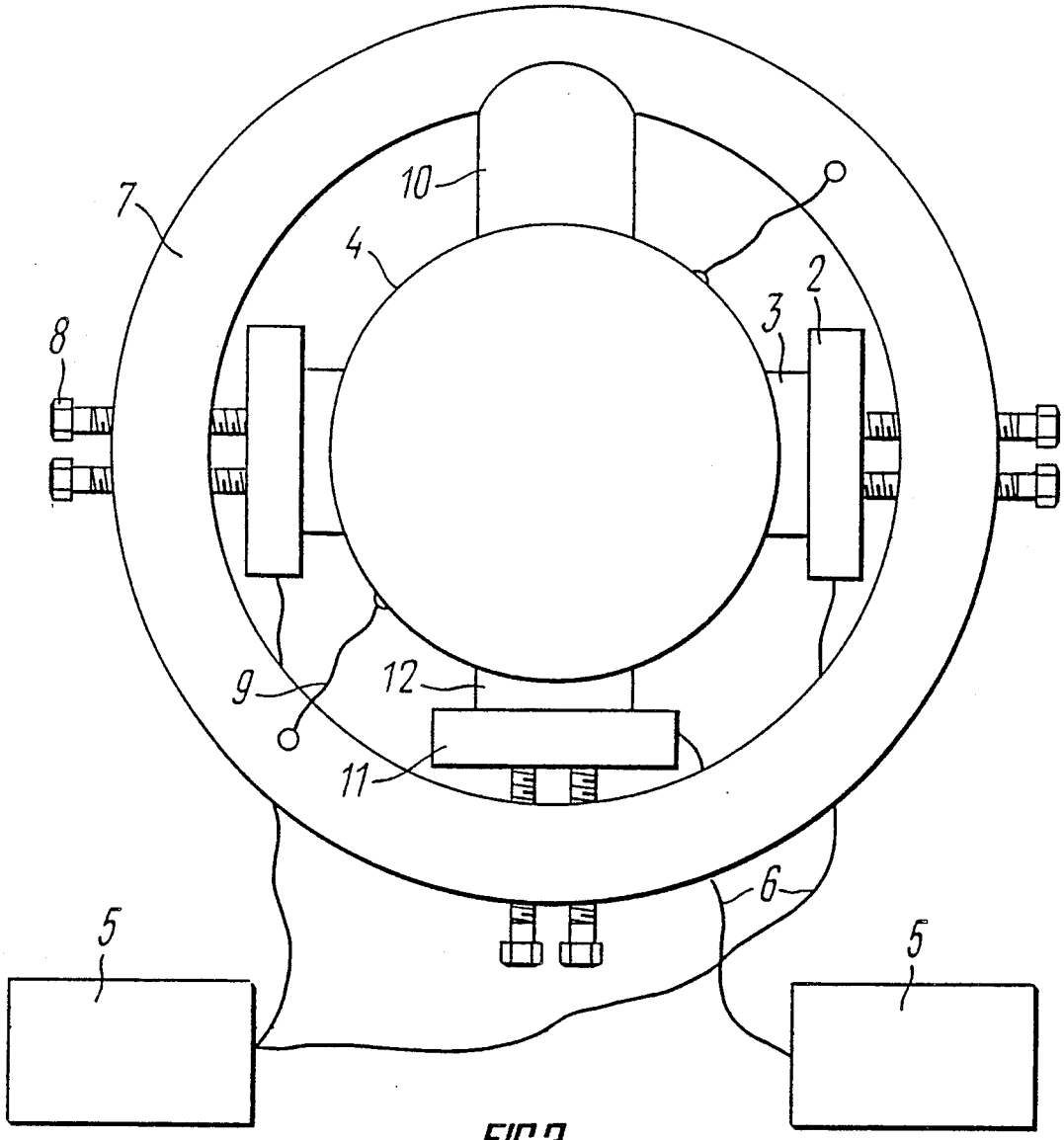
FIG. 3 illustrates, also in a plan view, an apparatus for vibratory cleaning the surface of an article from foreign matter, wherein the striking member includes an electromagnetic inductor with a plate closely adjoining this inductor, in accordance with the invention.

In another embodiment of the apparatus for vibratory cleaning the surface of an article from foreign matter, at least one striking member 10 (FIG. 3) includes an electromagnetic inductor 11 with a plate 12 closely adjoining it, arranged between the electromagnetic inductor 11 and the surface of the article 4 to be cleaned. In this embodiment, the apparatus comprises an auxiliary source 5 of pulsed electric current connected to the electromagnetic inductor 11. The other striking member 10 is in the form of a portion of a metal bar, fast with the frame 7. With the striking member 10 being either in the form of a rigid element or in the form of the electromagnetic inductor 11 with the plate 12, the efficiency of the cleaning of the surface of the article 4 is chanced.

The apparatus for vibratory cleaning the surface of an article from foreign matter, embodying the present invention, operates as follows.

With current pulses from the source 5 (FIG. 1) being fed alternatingly to the two electromagnetic inductors 2, eddy currents are induced in the plates 3. The interaction of these eddy currents with the magnetic fields of the electromagnetic inductors 2 generates a force directed normally to the surface of the article 4 being cleaned. In their turn, the electromagnetic inductors 2 are acted upon by the reaction from the pulse of the force, transmitted via the frame 7 to the striking members 10 (FIG. 2), and hence, to the portions of the surface of the article 4 to be cleaned, engaged by these striking members 10.

Mechanical vibrations are set in the surface of the article 4 to be cleaned, resulting in the surface being cleaned from foreign matter. Thus, in a single actuation of the exciters 1 of mechanical pulses, mechanical vibrations are excited simultaneously at several portions of the surface of the article 4 to be cleaned, which increases the area of the cleaned surface and enhances the efficiency of the cleaning of the surface of the article 4 from foreign matter. However, in the areas of engagement of the surface of the article 4 being cleaned with the exciter or exciters 1 of mechanical pulses the amplitude of the mechanical vibrations is higher than in the areas of engagement of the surface of the article 4 with the striking member or members 10 made in the form of a rigid element or elements. Therefore, it can be expedient to have at least one of the striking members 10 in the form of an electromagnetic inductor 11 (FIG. 3) with a plate 12. In this case, simultaneously with feeding current pulses to the exciter 1 of mechanical pulses, a current pulse is also fed to the electromagnetic inductor 11 with the plate 12. Consequently, the amplitude of mechanical vibrations generated in the area of engagement of the electromagnetic inductor 11 with its plate 12 with the surface of the article 4 being cleaned is increased at least twofold in comparison with the amplitude of mechanical vibrations produced in the area of engagement of the surface of the article 4 being cleaned by the striking member 10 in the form of a rigid element. Thus, the embodiment of FIG. 3 further enhances the efficiency of the cleaning of surface of the article 4 from foreign matter.

Thus, the disclosed apparatus for vibratory cleaning the surface of an article from foreign matter provides for enhancing the efficiency of the surface cleaning operation.

INDUSTRIAL APPLICABILITY

The invention can be used for cleaning the walls of bins, hoppers, driers, cyclones, pipelines and other similar equipment from sticking, and handling loose materials, ice and other unwanted or foreign matter.

We claim:

1. An apparatus for vibratory cleaning the surface of an article from foreign matter, comprising at least one exciter of mechanical pulses, including an electromagnetic inductor connected to a source of pulsed electric current and a plate made of an electrically conductive material, arranged between the electromagnetic inductor and the surface of the article to be cleaned, characterized in that it further comprises a frame (7) having fixedly mounted thereon the electromagnetic inductor (2) and the plate (3) closely adjoining this electromagnetic inductor (2), and at least one striking member (10) arranged between the frame (7) and the surface of the article (4) to be cleaned in the area of the most probable location of the foreign matter, the striking member (10) being fixedly mounted on the frame (7).

2. An apparatus for vibratory cleaning the surface of an article from foreign matter according to claim 1, characterized in that the striking member (10) is in the form of a rigid element.

3. An apparatus for vibratory cleaning the surface of an article from foreign matter, according to claim 1, characterized in that at least one striking member (10) is in the form of an electromagnetic inductor (11) connected to an auxiliary source (5) of pulsed electric current, with a plate (12) closely adjoining this electromagnetic inductor (11) and arranged between the electromagnetic inductor (11) and the surface of the article (4) to be cleaned.

* * * * *

UNITED STATES PATENT AND TRADEMARK OFFICE

CERTIFICATE OF CORRECTION

PATENT NO. : 4,993,098

DATED : February 19, 1991

INVENTOR(S) : V.D. KHARITONOV ET AL

It is certified that error appears in the above-identified patent and that said Letters Patent is hereby corrected as shown below: Title page:

Column 1, Item [73] Assignee:

Please insert -- Filial Vsesojuznogo Elektrotekhnicheskogo Instituta Imeni V.I. Lenina - Moskovskaya oblast, USSR; --Vsesojuzny Nauchno-Issledovatelsky I Konstruktorsky Institut Molochnoi Promyshlennosti-- .

Signed and Sealed this

Thirteenth Day of October, 1992

*Attest:*

DOUGLAS B. COMER

*Attesting Officer*

*Acting Commissioner of Patents and Trademarks*